US008839776B2

(12) United States Patent
Kingsbury et al.

(10) Patent No.: US 8,839,776 B2
(45) Date of Patent: Sep. 23, 2014

(54) BOW STABILIZER WITH INTEGRATED ADJUSTABLE ACCESSORY MOUNTING RAILS

(71) Applicants: Klint M. Kingsbury, Austin, TX (US); Clayton W. Reinarz, New Braunfels, TX (US)

(72) Inventors: Klint M. Kingsbury, Austin, TX (US); Clayton W. Reinarz, New Braunfels, TX (US)

( * ) Notice: Subject to any disclaimer, the term of this patent is extended or adjusted under 35 U.S.C. 154(b) by 0 days.

(21) Appl. No.: 14/066,627

(22) Filed: Oct. 29, 2013

(65) Prior Publication Data

US 2014/0216433 A1 Aug. 7, 2014

Related U.S. Application Data

(63) Continuation-in-part of application No. 13/005,461, filed on Jan. 12, 2011, now Pat. No. 8,567,382.

(60) Provisional application No. 61/294,410, filed on Jan. 12, 2010.

(51) Int. Cl.

| | |
|---|---|
| ***F41B 5/20*** | (2006.01) |
| ***F41B 5/14*** | (2006.01) |
| *F41G 1/00* | (2006.01) |
| *F41G 1/467* | (2006.01) |
| *F41G 11/00* | (2006.01) |

(52) U.S. Cl.

CPC ..... *F41B 5/1426* (2013.01); *F41B 5/14* (2013.01); *F41B 5/1492* (2013.01); *F41G 1/467* (2013.01); *F41G 11/003* (2013.01); *F41G 11/002* (2013.01)

USPC ..... 124/89; 124/1; 124/86; 124/88; 42/124

(58) Field of Classification Search

CPC ..... F41B 5/1426; F41B 5/14; F41B 5/1492; F41G 1/467; F41G 11/002; F41G 11/003

USPC ..... 124/1, 86, 88, 89; 42/124

See application file for complete search history.

(56) References Cited

U.S. PATENT DOCUMENTS

| | | | | | |
|---|---|---|---|---|---|
| 3,483,623 | A | * | 12/1969 | Kruzell | 42/127 |
| 4,296,725 | A | * | 10/1981 | Broderick | 124/23.1 |
| 4,640,258 | A | * | 2/1987 | Penney et al. | 124/24.1 |
| 4,890,128 | A | * | 12/1989 | Kania | 396/426 |
| 5,297,533 | A | | 3/1994 | Cook | |
| 5,339,793 | A | * | 8/1994 | Findley | 124/89 |
| 5,520,164 | A | | 5/1996 | Huddleston | |
| 5,558,078 | A | * | 9/1996 | Dunlap | 124/89 |
| D386,552 | S | | 11/1997 | Kunz | |
| D406,300 | S | | 3/1999 | Fitzgerald, Jr. | |
| D406,301 | S | | 3/1999 | Fitzgerald, Jr. | |
| D410,272 | S | | 5/1999 | Fitzgerald, Jr. | |

(Continued)

*Primary Examiner* — Gene Kim
*Assistant Examiner* — Alexander Niconovich
(74) *Attorney, Agent, or Firm* — Kammer Browning PLLC

(57) ABSTRACT

A bow stabilizer incorporating one or more attachment rails for mounting a variety of accessories to the stabilizer for use in conjunction with the bow or other target sighting device. The stabilizer is rotationally adjustable about a center axis attachment post connecting the stabilizer to the bow. In addition to rotating the stabilizer for balance, the rails are individually adjustable side to side at their ends and are preferably of the picatinny or weaver rail configuration. Anywhere from one to four (or more) accessory rails may be positioned symmetrically or asymmetrically on the stabilizer. One or more counterbalance weights may be adjustably positioned on one or more of the rails to offset and balance the weight of attached accessories.

17 Claims, 7 Drawing Sheets

(56) References Cited

U.S. PATENT DOCUMENTS

| | | | | |
|---|---|---|---|---|
| 5,911,215 | A | 6/1999 | Fisher, Jr. | |
| 6,179,510 | B1 * | 1/2001 | Meicke et al. | 403/306 |
| D446,278 | S | 8/2001 | Fitzgerald, Jr. | |
| 6,425,697 | B1 * | 7/2002 | Potts et al. | 396/426 |
| D469,839 | S | 2/2003 | Gibbs | |
| 6,556,245 | B1 * | 4/2003 | Holmberg | 348/333.01 |
| 6,672,299 | B2 | 1/2004 | Proctor | |
| 6,678,988 | B1 * | 1/2004 | Poff, Jr. | 42/147 |
| 6,722,076 | B2 | 4/2004 | Nielsen | |
| 6,742,723 | B2 | 6/2004 | Felegy | |
| 6,796,038 | B2 * | 9/2004 | Humphries | 33/265 |
| 6,895,676 | B1 * | 5/2005 | Mendyk | 33/265 |
| 7,006,144 | B2 * | 2/2006 | Holmberg | 348/373 |
| D561,292 | S | 2/2008 | Butcher | |
| 7,327,394 | B2 * | 2/2008 | Holmberg | 348/333.06 |
| 7,506,643 | B2 * | 3/2009 | Holmberg | 124/86 |
| 7,594,352 | B2 * | 9/2009 | Holmberg | 42/124 |
| D610,219 | S | 2/2010 | Harris et al. | |
| 7,793,645 | B2 * | 9/2010 | Walk et al. | 124/89 |
| 8,024,884 | B2 * | 9/2011 | Holmberg | 42/124 |
| 8,065,807 | B2 * | 11/2011 | Rucinski | 33/265 |
| 8,065,994 | B2 * | 11/2011 | Holmberg | 124/86 |
| 8,161,674 | B2 * | 4/2012 | Holmberg | 42/90 |
| D662,168 | S | 6/2012 | Sims et al. | |
| 8,205,375 | B1 * | 6/2012 | Swan | 42/124 |
| 8,225,778 | B2 * | 7/2012 | Walk et al. | 124/89 |
| D670,349 | S | 11/2012 | Felt et al. | |
| 8,656,624 | B2 * | 2/2014 | Holmberg | 42/90 |
| 2004/0000083 | A1 * | 1/2004 | Grant, Jr. | 42/112 |
| 2004/0007224 | A1 * | 1/2004 | Brown, Jr. | 124/87 |
| 2004/0016169 | A1 * | 1/2004 | Poff, Jr. | 42/124 |
| 2007/0031142 | A1 * | 2/2007 | Moody et al. | 396/419 |
| 2007/0079821 | A1 * | 4/2007 | Walk et al. | 124/86 |
| 2008/0000465 | A1 * | 1/2008 | Holmberg | 124/86 |
| 2008/0087784 | A1 * | 4/2008 | Holmberg | 248/309.1 |
| 2010/0224177 | A1 | 9/2010 | Kaylan | |
| 2010/0319670 | A1 * | 12/2010 | Sims et al. | 124/89 |
| 2010/0326415 | A1 * | 12/2010 | Walk et al. | 124/89 |
| 2011/0120440 | A1 * | 5/2011 | Stokes | 124/89 |
| 2012/0125310 | A1 * | 5/2012 | Khoshnood | 124/89 |

* cited by examiner

BOW STABILIZER WITH INTEGRATED ADJUSTABLE ACCESSORY MOUNTING RAILS

CROSS REFERENCES TO RELATED APPLICATIONS

This application claims the benefit under Title 35 United States Code §120 of co-pending U.S. patent application Ser. No. 13/005,461, filed Jan. 12, 2011, which further claims the benefit under 35 U.S.C. §119(e) of U.S. Provisional Patent Application Ser. No. 61/294,410, filed Jan. 12, 2010, the full disclosures of which are incorporated herein by reference.

BACKGROUND OF THE INVENTION

1. Field of the Invention

The present invention relates generally to stabilizers and vibration dampening mechanisms associated with bows and the like. The present invention relates more specifically to a bow stabilizer that incorporates one or more attachment rails for mounting a variety of accessories to the stabilizer for use in conjunction with the bow.

2. Description of the Related Art

Various stabilizer configurations are known in the art that are mounted to the forward oriented face of a bow to incorporate a variety of weights and balances that are used to stabilize the bow during use. The present invention improves upon existing bow stabilizer designs by incorporating one or more mounting rails into the structure of the stabilizer so as to permit the placement of accessories, such as sight lasers, lights, and other targeting components onto the bow. In addition, the present invention contemplates adjustable accessory mounting rails that may be positioned on other parts of the bow not associated with the stabilizer. The structure and use of the stabilizing device of the present invention is disclosed in the attached drawings.

DETAILED DESCRIPTION OF THE PREFERRED EMBODIMENTS

Figure 1A:
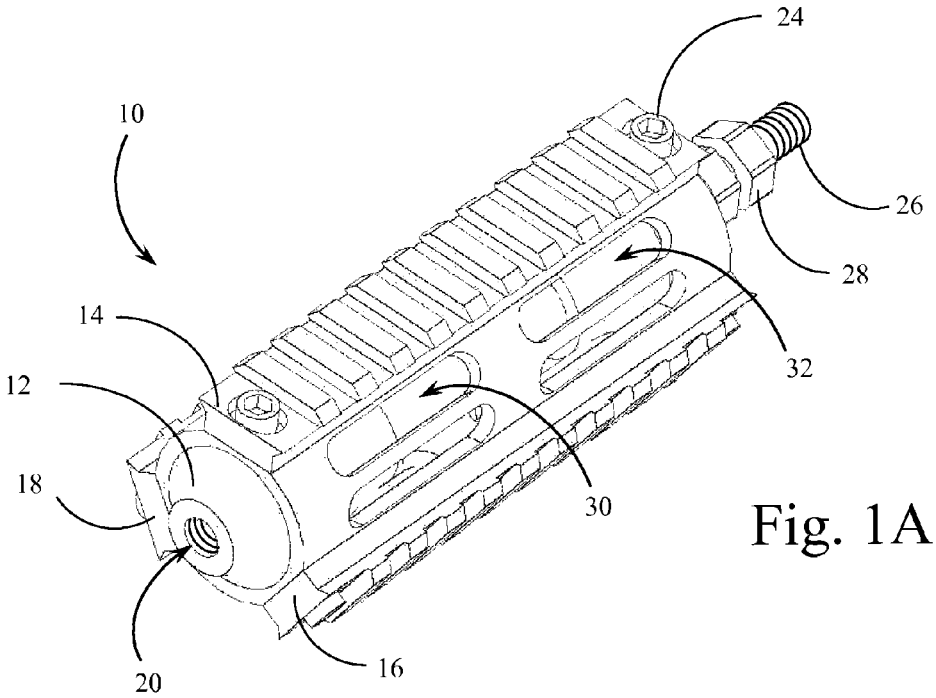
FIG. 1A is a perspective view of the stabilizer device of the present invention showing the incorporation of three adjustable rails (as an example) onto the stabilizer body.

The device of the present invention as shown generally in FIGS. 1A-1D is preferably constructed of aluminum, having a vibration dampening structure comprising a stainless steel bar suspended internally with rubber straps on the inside of the aluminum cylindrical frame. Incorporated onto the cylindrical structure of the stabilizer are (in this example) three adjustable mounting rails, typically referred to as picatinny rails or weaver rails. Each of the rails (shown in greater detail in FIG. 3) are mounted to the exterior circumference of the stabilizer cylindrical frame by means of allen head bolts, as shown in detail in FIGS. 2A & 2B. These bolts hold the picatinny/weaver rails to the stabilizer tube as shown in FIG. 1A.

Each of the rails incorporates two recessed slots for receiving the allen head bolts (one at each end) and allowing for rail alignment adjustment. The allen head bolts may simply be loosened on one or both ends of the rail and the associated accessory (a light or laser, typically) may be sighted-in. The accessory should be aligned with the bow at full draw during which the allen head bolts are re-tightened to fix the rail in alignment.

Referring to FIGS. 1A-1D, the various components of the stabilizer device of the present invention are shown and may be described as follows herein. FIG. 1A is a perspective view of the stabilizer device of the present invention shown removed from the bow and without any attached accessories. In this view, stabilizer vibration dampener 10 is seen to be comprised of stabilizer body 12, which in the preferred embodiment is a generally hollow cylindrical structure, within which is positioned vibration dampening bar 30 suspended between vibration dampening elastic members 32. Such internal structures for vibration dampeners are known in the art.

Positioned around the circumference of stabilizer body 12 are a number of picatinny/weaver rails 14, 16, and 18 each adjustably attached to stabilizer body 12. A first rail 14 is shown positioned along the top of the cylindrical stabilizer body 12 and is attached at a forward and rear end of the rail with rail adjustment bolts 24. A second rail 16 is similarly attached at a 120° angle from first rail 14 as shown, and a third rail 18 is positioned at a further 120° angle from second rail 16.

As indicated above, the number of rails positioned on the stabilizer structure of the present invention may vary according to the needs of the user. One benefit of the picatinny rail structure is the ease with which different accessories may be positioned and used or removed and replaced by other accessories. Incorporating a plurality of such rails on the stabilizer device makes it convenient for the user to "store" accessories in position on the device even when such accessories are not in use. The use of three equally spaced rails as shown in the preferred embodiment accommodates most of the commonly used types of accessories associated with bow hunting. Those skilled in the art will see that an adaptation of the preferred embodiment incorporating four rails positioned at 90° angles to each other might serve equally as well for certain accessories and certain applications. The preferred embodiment utilizing three rails lends particular efficiency to the use of the sighting accessories, such as a light or laser, on an upper oriented rail while providing two lower rails positioned at the 120° angles apart as mentioned that remain accessible for use with extended bi-pod legs or the like. As indicated above, the use of two, three, four or more such rails on the cylindrical stabilizer body may be anticipated.

Figure 4:
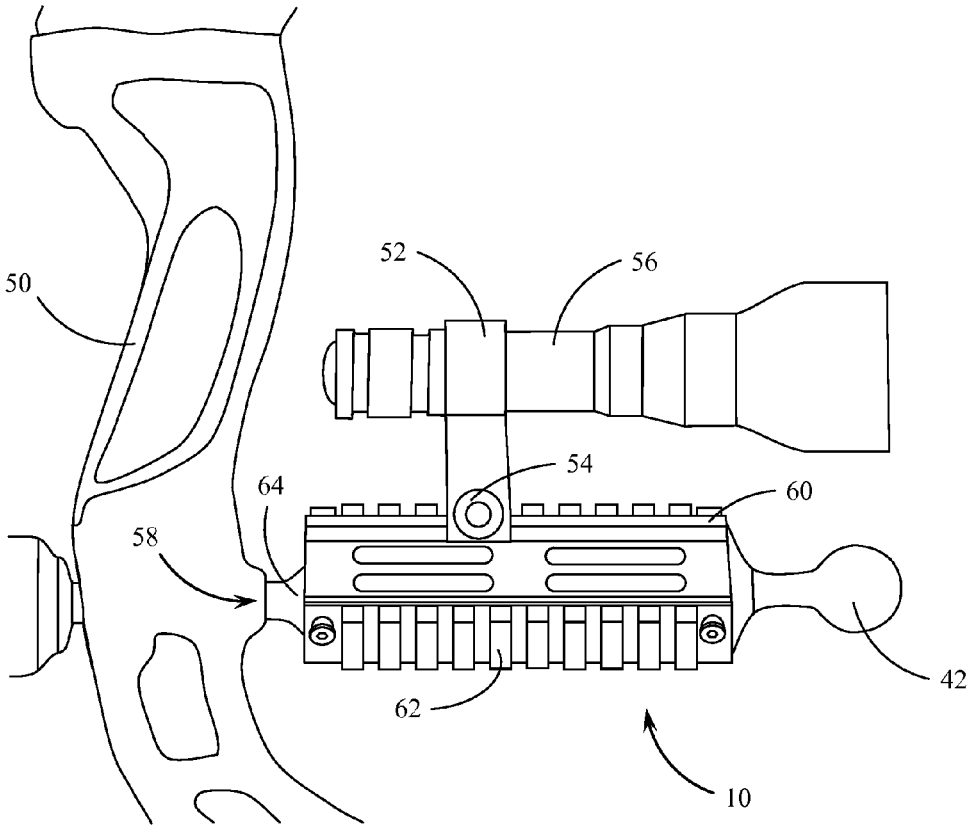
FIG. 4 is a side plan view of the device of the present invention shown mounted to the forward facing side of a typical archery bow and having attached thereto a stabilizer weight (to the forward end) and an accessory (a light) mounted to the mounting rails.

Positioned on the forward end of stabilizer body 12 as shown in FIG. 1A is threaded aperture 20 configured for mounting further accessories, such as additional stabilizer devices and/or stabilizer weights (as shown in FIG. 4). The geometry of threaded aperture 20 should be such as to match the geometry of threaded attachment post 26 positioned on the opposite end of stabilizer body 12. Threaded attachment post 26 is constructed to fit into standard sized threaded apertures positioned on most compound bows, such as that shown in FIG. 4. The threaded post 26 provides the mechanism for attaching the stabilizer device of the present invention to the bow. Adjustment hex nuts 28 are positioned on threaded attachment post 26 so as to fix the rotational orientation of the stabilizer device on the bow. In other words, once threaded attachment post 26 is threaded into the corresponding aperture on the bow, attachment hex nuts 28 may be turned down to tighten the attachment post in that rotational orientation, thereby positioning the rails on the stabilizer device as desired.

Figure 1B:
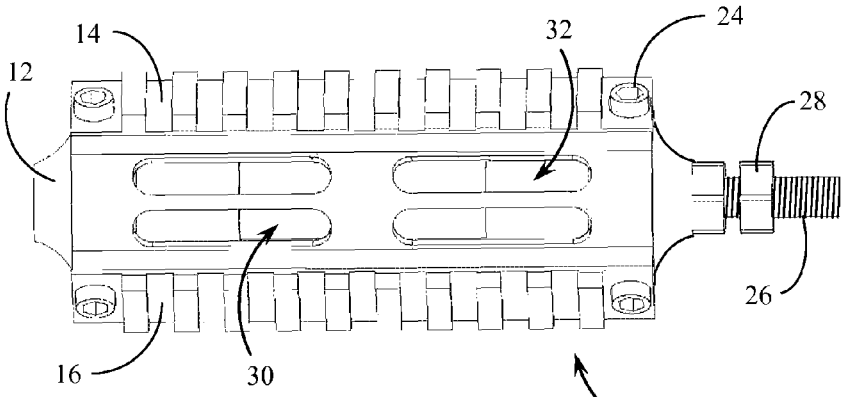
FIG. 1B is a side plan view of the stabilizer device of the present invention.

FIG. 1B is a side plan view of the stabilizer device 10 shown in FIG. 1A. In this view, the full length of two rails 14 and 16 can be seen at an angle. Each rail 14 and 16 incorporates rail adjustment bolts 24, one at each end. Vibration dampening bar 30 is seen within the cylindrical enclosure of stabilizer body 12 suspended between vibration dampening elastic members 32. Threaded attachment post 26 and adjustment hex nuts 28 are shown on the end of the stabilizer in position to be attached to the bow while the opposite end remains open (threaded aperture 20, not shown in this view) for attachment of a further stabilizer or a weight.

Figure 1C:
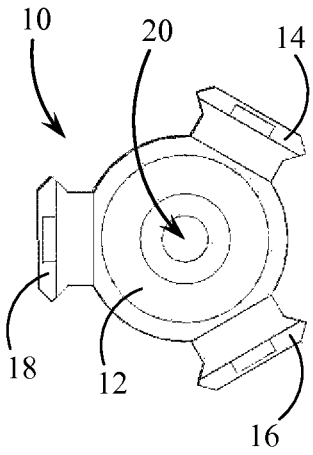
FIG. 1C is an end view of the stabilizer device of the present invention seen on the end away from the point of attachment to the bow.
Figure 1D:
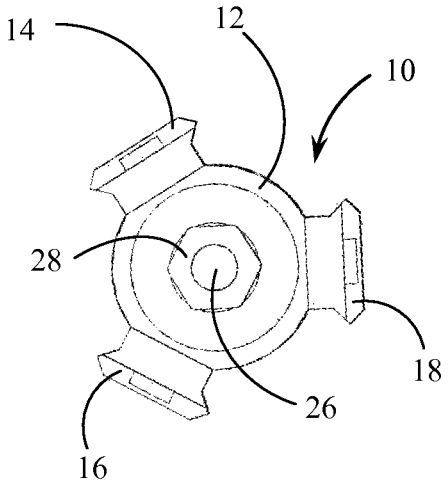
FIG. 1D is an end view of the stabilizer device of the present invention seen on the end that is attached to the bow.

FIG. 1C is an end view of the stabilizer of the present invention showing the forward facing end of the device with threaded aperture 20 centrally positioned for receiving and attaching a further stabilizer or a stabilizer weight. FIG. 1D is a view of the bow attachment end of the stabilizer device showing the end of threaded attachment post 26, as well as adjustment hex nuts 28. FIGS. 1C and 1D also show the ends of the picatinny rail structures for rails 14, 16, and 18, disclosing the manner in which an accessory device may be slid onto each of the rails from one end. The structure of the rail has a dovetail type of profile which provides longitudinal edges that the accessory bracket may be secured to in a manner described in more detail below.

Figure 2A:
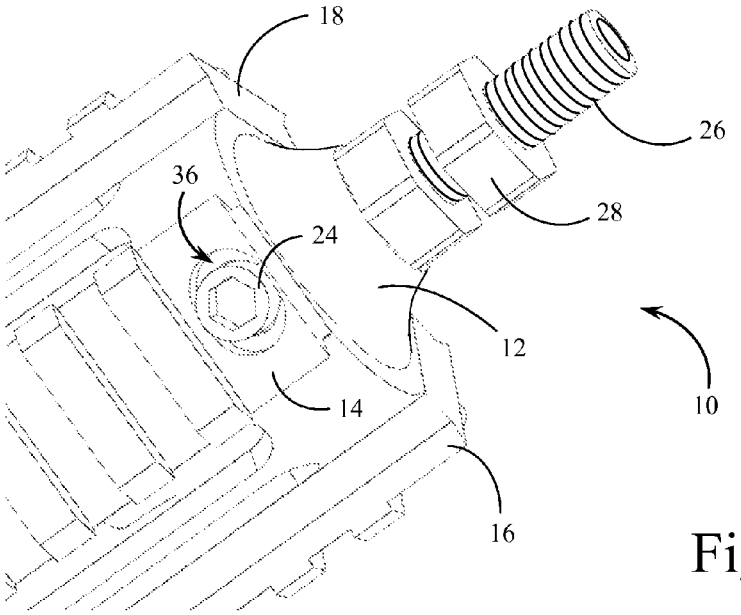
FIG. 2A is a detailed perspective view of one end of the stabilizer device of the present invention showing the manner in which each rail is itself adjustable side to side for accurately sighting-in the accessory to be mounted on the rail as well as a first manner (lock nut) of rotationally fixing the stabilizer onto the bow attachment post.

Reference is next made to FIG. 2A for a detailed description of one end of the stabilizer device of the present invention. In FIG. 2A, stabilizer 10 is shown in detail at the end that is attached to the bow. In this view, the end of each of the three rails 14, 16, and 18 can be seen. Rail 14 is viewed from above and details the placement and positioning of one of two rail adjustment bolts 24. Rail 14 incorporates at its end an elongated slot 36 which provides an aperture through which adjustment bolt 24 is placed and threaded into stabilizer body 12. Slot 36 provides a surface for tightening the adjustment bolt 24 down to fix the rail in position, and because of its oblong shape, allows for side to side adjustment of the end of rail 14 so as to accurately sight-in the accessory that is positioned on the rail. Also shown in FIG. 2A are the adjustment hex nuts 28 that are positioned on threaded attachment post 26 and are used to fix the rotational orientation of the stabilizer on the bow. Threaded post 26 provides the actual attachment to the bow and the use of one or more adjustment hex nuts 28 secures the rotational orientation of the stabilizer and thereby of the plurality of attachment rails. Gross adjustment of the positioning of the accessory may therefore be accomplished by fixing the rotational orientation of the stabilizer, while fine adjustment may be accomplished by means of the rail adjustment bolts 24 positioned on each end of each rail.

Figure 2B:
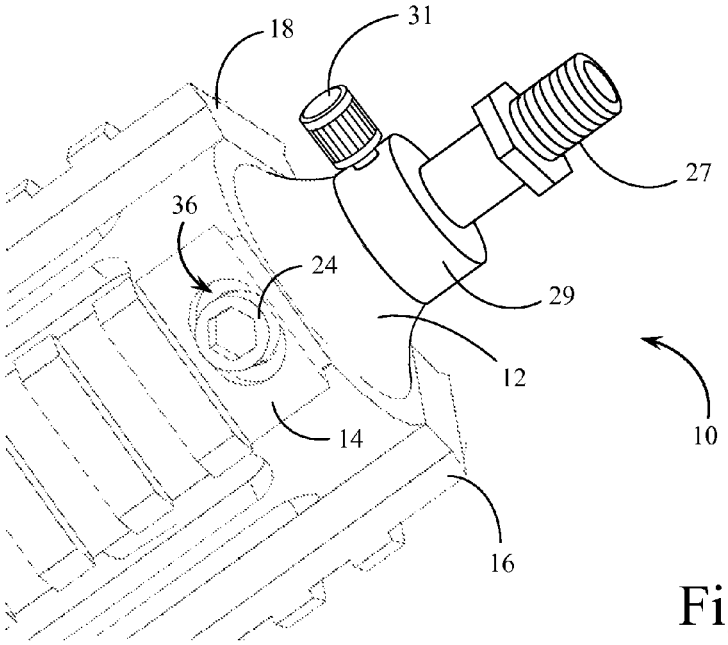
FIG. 2B is a detailed perspective view of one end of the stabilizer device of the present invention showing the manner in which each rail is itself adjustable side to side for accurately sighting-in the accessory to be mounted on the rail as well as a second manner (set screw) of rotationally fixing the stabilizer onto the bow attachment post.

FIG. 2B is a detailed perspective view of one end of an alternate embodiment of the stabilizer device of the present invention, again showing the manner in which each rail is itself adjustable side to side for accurately sighting-in the accessory to be mounted on the rail as well as a second manner (set screw) of rotationally fixing the stabilizer onto the bow attachment post. In this alternate embodiment, the lock nut arrangement shown in FIG. 2A is replaced with a set screw arrangement as an alternate way of fixing the stabilizer body in a specific rotational orientation. Threaded post 27 includes a hex nut portion that facilitates securing the post into the threaded aperture typically found on the bow stock (see FIG. 4). The remaining portion of the post on the side of the stabilizer need not be threaded and is longitudinally fixed but free to rotate within the fixed coupling 29 on the stabilizer. Set screw 31 may be loosed or tightened to secure and fix the rotational orientation of the stabilizer. Mechanisms other than the lock nut and set screw disclosed in FIGS. 2A & 2B are anticipated for fixing the rotational orientation. Various quick release lever mechanisms (such as those utilized on bicycle wheel hubs) may be used to facilitate the rapid release and re-securing of the rotation of the stabilizer. Various twist lock mechanisms (such as those utilized on drill chucks) may also be used.

Figure 3:
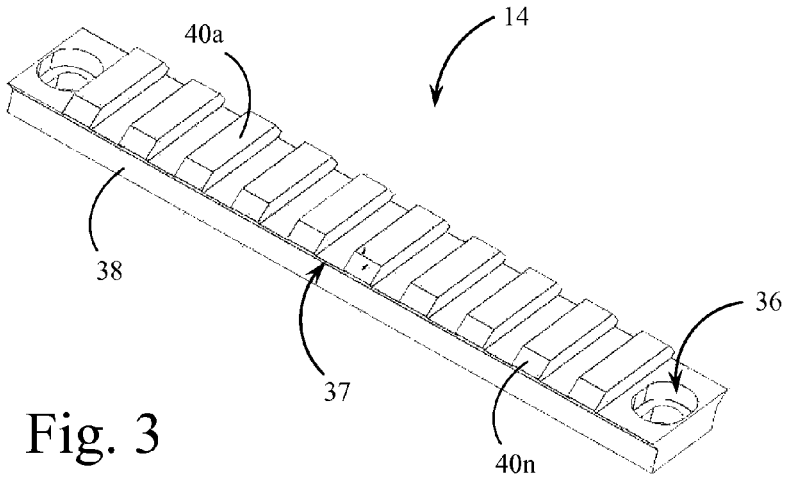
FIG. 3 is a detailed perspective view of a typical mounting rail associated with the stabilizer device of the present invention.

FIG. 3 is a detailed view of one typical rail 14 of the present invention shown detached from the stabilizer body. The rail 14 is shown as a longitudinal structure with an elongated adjustment bolt recess 36 configured at each end. Rail base 38 supports the dovetail profile shown in FIGS. 1C and 1D thereby configuring the rail with an upper edge on each side that the accessory attachments may be secured to. Individual rail bars 40*a*-40*n* are shown as is typical for picatinny/weaver rail structure.

Reference is finally made to FIG. 4 for a detailed description of the manner in which the stabilizer device of the present invention may be attached to a bow and fitted with one or more of a variety of different accessories. In FIG. 4, bow 50 is shown with stabilizer 10 positioned and rotationally oriented for the use of mounted accessory 56. Stabilizer 10 is positioned on bow 50 at threaded attachment aperture 58 which receives the threaded attachment post 26 (not shown in FIG. 4) which itself is secured to the attachment end 64 of the stabilizer 10. In this view, rails 60 and 62 may be seen with rail 60 positioned in an upright orientation so as to receive accessory 56. Also shown in this view is stabilizer weight 42 which is attached to the threaded aperture 20 on the forward facing end of the stabilizer.

Accessory 56 in the example shown in FIG. 4 may be a battery powered light or laser that is used for illuminating the target area or for spotting the target with a laser. In any case, the light generating device is positioned with a bracket 52 configured to hold the accessory 56 and to extend it a short distance from mounting rail 60 as shown. Bracket 52 may initially be slid onto rail 60 from the outward end of the rail back to an appropriate position along the rail. Knob 54 is, in the preferred embodiment, a hand tightened knob that, once bracket 52 is properly positioned on either side of rail 60, may be used to secure the bracket and the accessory into place. Longitudinal adjustments to the accessory 56 may therefore be made by loosening knob 54 and sliding bracket 52 forward or backward along rail 60, thereafter re-tightening knob 54. The placement of accessory 56 on the upper oriented rail as shown in FIG. 4 leaves open the remaining two rails for use with other accessories or with bi-pod legs that would extend down at the 120° angles generally preferred for such support structures.

The present invention anticipates other methods of adjusting the rail alignment in addition to that shown in the specific embodiment in the drawing figures. For example, the rail may be attached to a side screw adjustment device that moves the rail side to side based upon rotation of the adjustable screw. The cylindrical configuration of the stabilizer shown is a screw-in bow stabilizer that is mounted to a receiving bracket permanently positioned on the bow itself. The requirement for rail alignment in general is due to the twisting effect on the bow riser as the cams (in a compound bow) roll over. The string at full draw becomes slightly angled with respect to the riser. Thus the stabilizer and rails are not necessarily aligned with the point of impact. In this manner, the adjustment capabilities of the present invention are critical, especially with archery targeting type applications.

Figure 5A:
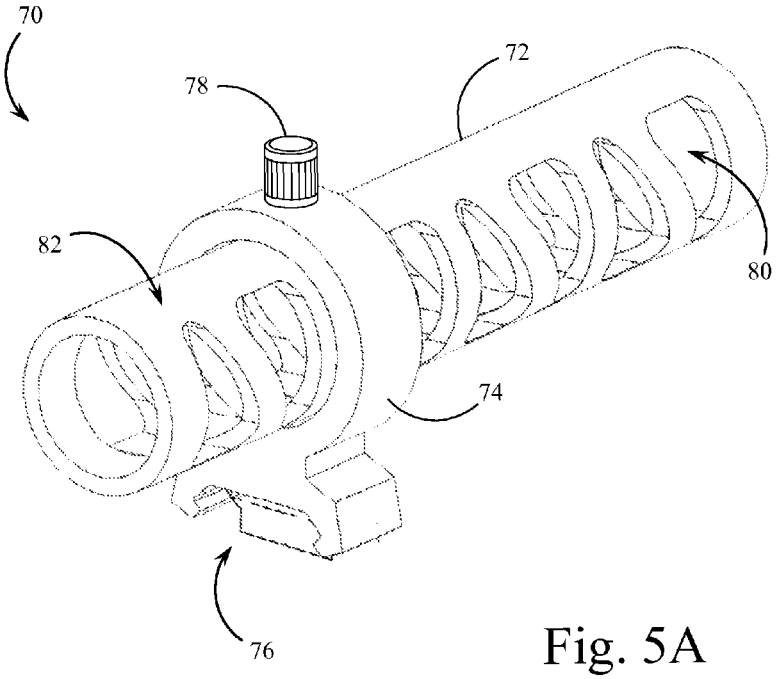
FIGS. 5A-5D are isometric and plan views of an adjustable counterbalance weight device suitable for positioning on one or more of the longitudinal rails of the stabilizer of the present invention.

Reference is next made to FIGS. 5A-5D for a description of an adjustable counterbalance weight suitable for positioning on one or more of the longitudinal rails of the stabilizer body of the present invention. FIG. 5A is a perspective view of adjustable counterbalance weight 70 which is constructed primarily of weight cylinder 72 and ring clamp 74. Ring clamp 74 is configured with a rail receiving slot 76 suitable for attachment to any of the longitudinal rails positioned on the stabilizer body. Weight cylinder 72 fits within ring clamp 74 and is secured therein with set screw 78. Weight cylinder 72 is preferably a hollow cylindrical section of aluminum or other metal with cutouts 80. Movement of weight cylinder 72 within ring clamp 74 allows for fine adjustment of the positioning of the weight. Weight cylinder 72 includes clamp surface 82 extending the length of the cylinder to provide a solid surface onto which set screw 78 may be directed. In this manner, weight cylinder 72 is secured within ring clamp 74 and is adjustable longitudinally through ring clamp 74 to provide fine linear adjustment to the counterbalance weight.

Figure 5B:
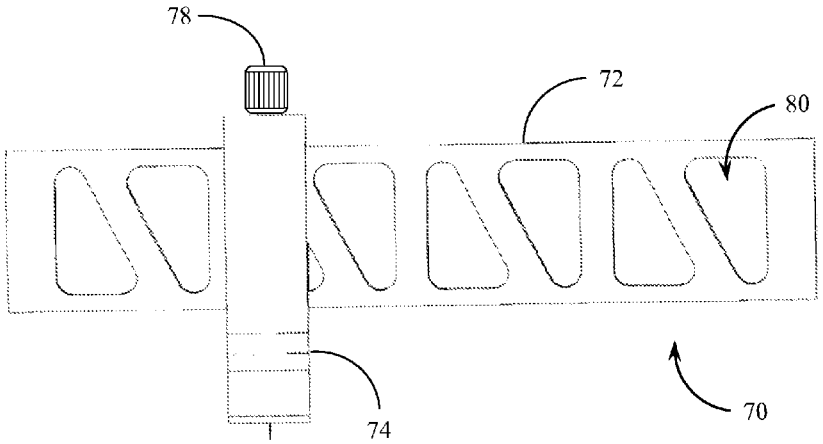
Figure 5C:
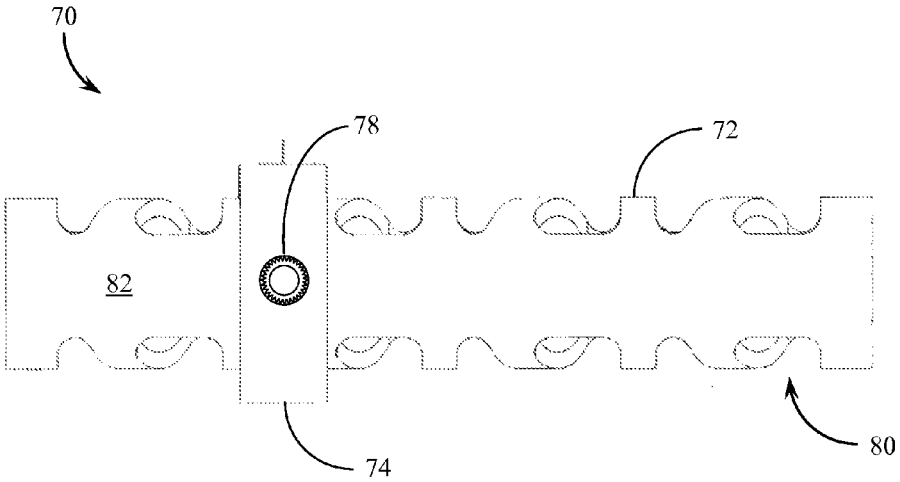
Figure 5D:
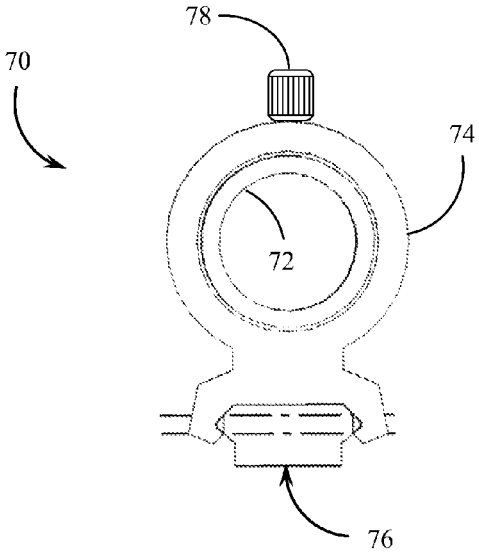

FIG. 5B is an elevational side view of adjustable counterbalance weight 70, showing in greater detail the various cutouts 80 through weight cylinder 72. Weight cylinder 72 is adjustably positioned through ring clamp 74 and is secured in position by use of set screw 78. FIG. 5C is a top plan view of adjustable counterbalance weight 70, disclosing in greater detail clamp surface 82 along one edge of weight cylinder 72, positioned so as to provide a solid surface for set screw 78 to contact within ring clamp 74. Finally, FIG. 5D shows an end view of adjustable counterbalance weight 70 positioned with rail slot 76 surrounding one of the longitudinal rails on the stabilizer body (not shown). Ring clamp 74 encompasses weight cylinder 72 and again holds weight cylinder 72 in place by means of set screw 78.

As one of the primary objects of the present invention is to provide easy adjustability to the various accessories that may be positioned on the longitudinal rails of the stabilizer body, it is important that the user is able to balance the overall bow (with stabilizer and accessories) side to side, as well as to adjustably orient the individual accessories positioned along the longitudinal rails of the stabilizer body. One objective of the present invention is to provide an archery stabilizer with uniformly positioned (radially arrayed) tactical rails in front of the bow to achieve balance of the bow, while maintaining the ability to mount tactical devices to the uniformly spaced rails. This balance is generally achieved through the use of the screw-in design of the stabilizer body as described above. The objective is to provide a stabilizer that allows the user to align standard tactical rails and thus accessories with a target.

The archery stabilizer of the present invention therefore has two discrete functions, side to side balance and vibration reduction. Most existing cylindrical stabilizers simply provide vibration reduction through the use of various springs and/or resilient components configured within the cylindrical body. Little or no attention is given to the use of the stabilizer as a means for adjustably balancing the bow, especially where accessories have been positioned on the stabilizer in the manner described herein.

One objective of the present invention is therefore to maintain the balance of the accessories on the bow while still being able to align accessories with the target. The individual longitudinal rails are adjustable by means of the attachment screws fixed in slots on the ends of the rails as described above. In addition to this individual rail adjustability, however, the overall stabilizer body is rotationally adjustable and may be fixed in a rotated position utilizing the locking nut on the screw-in attachment post that allows the uniformly positioned rails to be radially oriented as needed for balance. The fixing of the rotation of the stabilizer body on the attachment post may also be achieved with a set screw (see FIG. 2B) through the side of the stabilizer body. This rotational positioning feature allows the longitudinal rails to be positioned such that one rail may face directly upward (for example) so as to align an accessory in a vertical orientation, such as for a camera. Such an alignment may be necessary not only for balance of the bow, but also to provide correct alignment of the camera accessory (achieving a video that is not canted sideways). Other mounts for cameras are known that orient such devices in a vertical manner, but not with tactical rails and not incorporated onto a balancing stabilizer.

A further accessory commonly utilized in conjunction with archery is a laser pointer or spotter. When such a laser device is mounted on a stabilizer, often 6-8 inches below the arrow, the laser would typically run out of vertical adjustment such that it can not be sighted-in at normal archery distances (10-20 yards). As such, the rails must be positioned so that the laser is rotated 90° from the vertical. This may be accomplished using the rotational alignment feature of the stabilizer body of the present invention, incorporating either a lock nut or a set screw as described above. Thereafter, the pivoting feature of the individual rail, adjustable at its end points, is utilized to point the laser up slightly towards the line of arrow flight. This allows the user to correctly sight-in a laser using the tactical rail stabilizer of the present invention.

Figure 6:
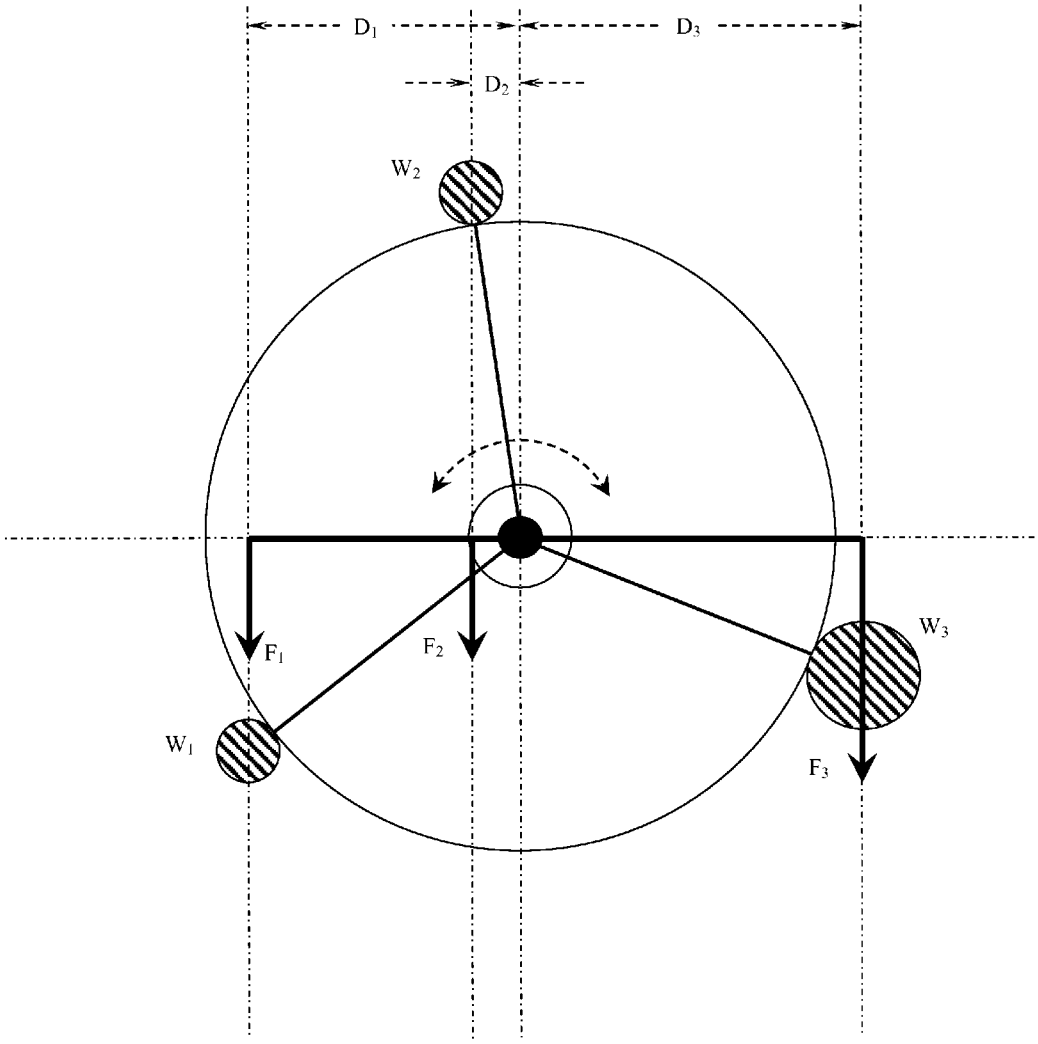
FIG. 6 is a schematic force diagram showing a typical arrangement of accessories of various weights positioned radially around a center point (fulcrum) describing the balancing of torques or moments with the stabilizer of the present invention.

FIG. 6 provides greater detail on the balancing feature of the stabilizer body of the present invention. FIG. 6 is a schematic diagram, essentially viewing the stabilizer body end on (as from the view of the target). The center of the diagram in FIG. 6 represents the center axis of the longitudinal stabilizer body extending from its rotational mount on the bow stock. The three shaded circles in FIG. 6 represent a variety of accessories mounted at equiangular positions on the longitudinal rails that are fixed about the periphery of the cylindrically shaped stabilizer body. Other examples with fewer or more than three equiangular rails are, of course, anticipated.

Because the various accessories $W_1$, $W_2$, and $W_3$ will likely be of different weights and sizes, the process of balancing the array of accessories is made possible by the rotational pivoting of the stabilizer body about its axis, before being fixed as with a lock nut or set screw. FIG. 6 shows the physical properties that define balance for the accessories mounted on the stabilizer body. This balance is a side to side balance that prevents inadvertent tilting of the bow left to right or right to left due to the excessive weight of a particular accessory. In practice, the user would simply position the accessories on the longitudinal rails and loosen the rotational attachment post that holds the stabilizer body to the bow. Rotational adjustments are then made until the user determines that the accessories and their respective weights have been evenly distributed side to side. The user then fixes the stabilizer body in the rotational orientation determined to provide the best balance.

Mathematically, what the user is achieving by way of balancing the accessories, is a matching of moment arms around the center fulcrum point (the central axis of the stabilizer) based upon the weights of the various accessories and their relative distances (horizontally) from a vertical center line representing the gravitational force on each of the accessories. As known in the field of mechanics, a force $F_1$ exerted downward by a weight $W_1$ creates a torque or moment equal to the product of the force or weight and the distance $D_1$ from the fulcrum point. In the example shown in FIG. 6, $(W_1 \times D_1)+(W_2 \times D_2)=(W_3 \times D_3)$ in order for balance to be achieved.

An explanation of the rotational characteristics of the stabilizer body of the present invention is made with the level of detail shown in FIG. 6 primarily to emphasize the unique versatility of the stabilizer body of the present invention to provide side to side balance, vibration dampening, and longitudinal angle alignment, for the full set of accessories that may be incorporated onto the stabilizer body. The versatility of both the rotational orientation (as described in FIG. 6) and the longitudinal angular alignment (as described above with the adjustable longitudinal rails) provides full accessory alignment capabilities for the user.

A wide variety of accessories are structured with the typical picatinny rail/weaver rail type mounting bracket. The examples provided in the present application are not intended to be limiting of the various accessories that can be utilized in conjunction with the stabilizer of the present invention. Other tactical accessories such as lights, lasers, cameras, bipods, monopods, quiver counterweights, etc. may be attached to these mounting rails. Various accessories will require more or less ability of the user to adjust the orientation of the rail. Modifications to the size, structure and orientation of the stabilizer device of the present invention will be apparent to those skilled in the art. Where such modifications relate primarily to the size and structure of the bow to which the stabilizer is to be attached, or to the various accessories that are to be attached to the mounting rails on the stabilizer, do not necessarily depart from the spirit and scope of the invention.

We claim:

1. A bow stabilizer for use in conjunction with an archery bow, the stabilizer serving to balance the bow and to minimize vibration during use and to additionally provide attachment points for accessories utilized in conjunction with the bow, the bow stabilizer comprising:

a generally cylindrical stabilizer body having a peripheral outer wall, a cylindrical axis, and first and second ends;

an attachment post positioned at the first end of the stabilizer body at the cylindrical axis, for rotational attachment of the stabilizer body to the archery bow, the cylindrical axis of the stabilizer body extending from the archery bow in a target orientation; and a plurality of longitudinal rails each adjustably positioned on the peripheral outer wall of the stabilizer body in a longitudinal orientation, generally parallel with the cylindrical axis of the stabilizer body, each of the plurality of rails comprising first and second ends and a pair of parallel opposing longitudinal edges extending between the first and second ends onto which may be secured brackets for the support of accessories;

wherein one or more accessories with standard mounting brackets may be positioned on the plurality of rails on the stabilizer body, the stabilizer body may be rotated to balance the one or more accessories, and the one or more accessories may thereafter be utilized in conjunction with the operation of the archery bow.

2. The bow stabilizer of claim 1 wherein the attachment post positioned at the first end of the stabilizer body further comprises a threaded portion and at least one releasable locking nut to alternately allow and prevent rotation of the cylindrical stabilizer body about the cylindrical axis.

3. The bow stabilizer of claim 1 wherein the first end of the stabilizer body further comprises a collar rotationally positioned on the attachment post and at least one releasable set screw on the collar to alternately allow and prevent rotation of the cylindrical stabilizer body about the cylindrical axis.

4. The bow stabilizer of claim 1 wherein the plurality of longitudinal rails comprises three longitudinal rails positioned in an equiangular array around the peripheral outer wall of the cylindrical stabilizer body.

5. The bow stabilizer of claim 1 wherein each of the plurality of longitudinal rails comprise Picatinny rails.

6. The bow stabilizer of claim 1 further comprising at least one counterbalance weight positioned on one of the plurality of longitudinal rails.

7. The bow stabilizer of claim 6 wherein the at least one counterbalance weight comprises:

a ring clamp having a rail slot bracket and a ring shaped clamping member, the rail slot bracket adjustably attachable to one of the plurality of longitudinal rails; and a cylindrical weight member adjustably positioned within the ring clamp.

8. The bow stabilizer of claim 1 wherein the plurality of longitudinal rails each further comprise releasable attachment elements for securing each end of each rail to the stabilizer body, the attachment elements being adjustable at each end so as to allow angular orientation of the rail, and the accessory to be positioned on the rail, to be offset from an orientation parallel with the cylindrical axis of the stabilizer body.

9. The bow stabilizer of claim 8 wherein the releasable attachment elements comprise threaded bolts positioned through apertures in each of the first and second ends of each of the plurality of rails, the threaded bolts extending into aligned threaded apertures on the peripheral outer wall of the cylindrical stabilizer body.

10. The bow stabilizer of claim 9 wherein the apertures in each of the first and second ends of each of the plurality of rails are elongated in a direction orthogonal to the cylindrical axis, whereby loosening the threaded bolts allows for adjustment of the longitudinal orientation of the rails transverse to the target orientation.

11. The bow stabilizer of claim 9 wherein the threaded bolts are positioned in recessed apertures.

12. The bow stabilizer of claim 1 wherein the cylindrical stabilizer body further defines a threaded aperture at the second end of the stabilizer body, wherein a stabilizer weight having a threaded portion may be secured to the second end of the stabilizer body.

13. The bow stabilizer of claim 1 wherein the plurality of longitudinal rails comprises four longitudinal rails positioned in an equiangular array around the peripheral outer wall of the cylindrical stabilizer body.

14. The bow stabilizer of claim 1 wherein the cylindrical stabilizer body comprises a hollow cylinder, and wherein vibration dampening components are operationally positioned within the hollow cylindrical stabilizer body.

15. A bow stabilizer for use in conjunction with an archery bow, the stabilizer serving to balance the bow and to minimize vibration during use and to additionally provide attachment points for accessories utilized in conjunction with the bow, the bow stabilizer comprising:

a generally longitudinal stabilizer body having a length greater than its width, and having a peripheral outer wall, a longitudinal axis, and first and second ends;

an attachment post positioned at the first end of the stabilizer body for rotational attachment of the stabilizer body to the archery bow, the longitudinal axis of the stabilizer body extending from the archery bow in a target orientation;

at least one counterbalance weight positioned on one of a plurality of longitudinal rails, the at least one counterbalance weight comprising:

a ring clamp having a rail slot bracket and a ring shaped clamping member, the rail slot bracket adjustably attachable to one of the plurality of longitudinal rails; and a cylindrical weight member adjustably positioned within the ring clamp; and the plurality of longitudinal rails each adjustably positioned on the peripheral outer wall of the stabilizer body in a longitudinal orientation, generally parallel with the longitudinal axis of the stabilizer body, each of the plurality of rails comprising first and second ends and a pair of parallel opposing longitudinal edges extending between the first and second ends onto which may be secured brackets for the support of accessories;

wherein one or more accessories with standard mounting brackets may be positioned on the plurality of rails on the stabilizer body, the stabilizer body may be rotated to balance the one or more accessories, and the one or more accessories may thereafter be utilized in conjunction with the operation of the archery bow.

16. The bow stabilizer of claim 15 wherein the attachment post positioned at the first end of the stabilizer body further comprises a threaded portion and at least one releasable locking nut to alternately allow and prevent rotation of the cylindrical stabilizer body about the cylindrical axis.

17. The bow stabilizer of claim 15 wherein the first end of the stabilizer body further comprises a collar rotationally positioned on the attachment post and at least one releasable set screw on the collar to alternately allow and prevent rotation of the cylindrical stabilizer body about the cylindrical axis.

* * * * *